US006431542B1

(12) United States Patent
Tabuchi

(10) Patent No.: US 6,431,542 B1
(45) Date of Patent: Aug. 13, 2002

(54) MEDAL PLAYING MACHINE

(75) Inventor: Kazuhisa Tabuchi, Tokyo (JP)

(73) Assignee: Sammy Corporation, Tokyo (JP)

( * ) Notice: Subject to any disclaimer, the term of this patent is extended or adjusted under 35 U.S.C. 154(b) by 0 days.

(21) Appl. No.: 09/647,038

(22) PCT Filed: Feb. 2, 2000

(86) PCT No.: PCT/JP00/00606

§ 371 (c)(1),
(2), (4) Date: Sep. 25, 2000

(87) PCT Pub. No.: WO00/45911

PCT Pub. Date: Aug. 10, 2000

(30) Foreign Application Priority Data

Feb. 4, 1999 (JP) ..... 11-026857

(51) Int. Cl.[7] ..... A63B 71/00

(52) U.S. Cl. ..... 273/138.3; 273/290; 273/144; 273/138.2; 273/138.1

(58) Field of Search ..... 273/138.3, 290, 273/144 R, 138.2, 138.1

(56) References Cited

U.S. PATENT DOCUMENTS 5,297,816 A * 3/1994 Becchio ..... 273/459
5,667,218 A * 9/1997 Kumabe et al. ..... 273/138.3
5,752,699 A * 5/1998 Crompton et al. ..... 273/138.2
5,775,691 A * 7/1998 Hamano ..... 273/138.2
5,785,314 A * 7/1998 Hamano ..... 273/138.3
5,887,870 A * 3/1999 Kumabe et al. ..... 273/138.3
6,092,807 A * 7/2000 Yu ..... 273/144 R

FOREIGN PATENT DOCUMENTS

JP 08-019661 * 1/1996 ..... A63F/9/00
JP 10-179922 7/1998
JP 10-179926 7/1998
JP 11-26857 * 2/1999 ..... A63F/9/00

* cited by examiner

*Primary Examiner*—Benjamin H. Layno
*Assistant Examiner*—D Collins
(74) *Attorney, Agent, or Firm*—Wolf, Greenfield & Sacks, P.C.

(57) ABSTRACT

In a medal playing machine comprising a playing field which has a side edge at its front side, a gutter-shaped medal inlet device for supplying medals by rolling them onto the playing field, and a medal pusher which moves reciprocatedly on the playing field in a longitudinal direction, in order that the movement pattern of the obstructing means, which obstructs the medals from passing through the medal-passing gate formed in the medal pusher, may be complicated and that difficulty of the game may easily be adjusted, a plurality of vane plates 60 as the obstructing means, which obstruct the medals from passing through by pivoting transversely, are disposed at the medal-passing gate 21 of the medal pusher 10 so that the front ends of the vane plates 60 protrude frontward.

8 Claims, 6 Drawing Sheets

MEDAL PLAYING MACHINE

FIELD OF THE INVENTION

The present invention relates to a medal playing machine referred to as a so-called pusher playing machine in which medals deposited on its playing field and from which a player gains the medals pushed out by a medal pusher. Particularly, the present invention relates to the medal playing machine which also has a medal-passing gate at a front side of the medal pusher and, moreover, an obstructing means which obstructs the medals from passing through the medal-passing gate.

BACKGROUND OF THE INVENTION

Playing machines in which medals are used are classified to ones in which medals are used as a currency in playing the games and ones in which medals per se are objects of the games. An example of the former is a slot machine. On the other hand, an example of the latter is a so-called pusher playing machine.

The pusher playing machine is a playing machine in which a medal pusher can move reciprocatedly on a playing field. A player supplies medals onto the playing field and the supplied medals are gradually deposited on the playing field. Then, while the medal pusher moves reciprocatedly, the deposited medals are pushed out and they fall from the playing field. Namely, it is a purpose for the player who plays with the pusher playing machine to gain as many fallen medals as possible.

Some pusher playing machines have a medal-passing gate at a front side of its medal pusher.

Namely, the medal-passing gate is a space (e.g. a slit-shaped space) provided to the medal pusher, through which the medal rolls to pass. When the medal passes through the space, a prescribed lot drawing is performed. Then, according to a result of the lot drawing, a prescribed profitable condition is afforded to the player.

For example, some pusher playing machines have a medal supplier located above the playing field. Such a playing machine can afford the above-mentioned profitable condition to the player by supplying medals with the medal supplier onto the playing field according to a result of the lot drawing. Then, the player can gain more medals due to an increase of the number of medals pushed out by the medal pusher.

As an above-mentioned medal-passing gate, we can exemplify a comb-shaped obstructing plate provided at the front side of the medal pusher. Thus, the medals can roll to pass through the slits between the teeth of the comb.

Further, as disclosed in Japanese Laid-open Patent Publication H10-179922, we can also exemplify the one in which the above-mentioned comb-shaped obstructing plate can move in a transverse direction. Namely, the transverse movement of the obstructing plate in addition to the longitudinal movement of the medal pusher makes it more difficult for the medals to pass through the medal-passing gate.

Since the above-mentioned movement of the obstructing plate in the prior art is substantially composed of only a transverse movement and a longitudinal movement, the obstructing plate shows a regular movement pattern. Thus, a skilled player can easily see through the movement pattern and he loses his interest in playing the game.

Further, there has been a problem that, once the medal playing machine is installed, it is impossible or difficult to adjust the difficulty of the movement pattern.

SUMMARY OF THE INVENTION

In view of the above-mentioned drawbacks of the prior art, the present invention has a purpose to provide a medal playing machine which has a complicated movement pattern of the vane plates, instead of the obstructing plate, and in which the difficulty of the game can easily be adjusted, by providing the vane plates which pivot transversely in front of the medal-passing gate and thus obstruct the medals from passing through the medal-passing gate.

Further, in addition to the above-mentioned purpose, the present invention has another purpose to detect the abnormal operation caused by the entanglement of the medal.

Accordingly, the present invention discloses a medal playing machine which comprises a playing field with a side edge at its front side, a gutter-shaped medal inlet device for supplying medals by rolling them onto the playing field, and a medal pusher 10 which moves reciprocatedly in a longitudinal direction on the playing field. The medal pusher 10 is provided with a pushing plate 20 which pushes the medals on the playing field towards the side edge and makes them fall. The pushing plate 20 is provided with a medal-passing gate 21 through which the medal rolling on the playing field may pass. The medal-passing gate 21 is provided with a plurality of vane plates 60 whose distal ends protrude frontward from the pushing plate 20. The vane plates 60 pivot transversely so as to obstruct the medals from passing through the medal-passing gate 21.

Here, "frontward" means the near side as seen from the player. Accordingly, the far side as seen from the player becomes "backward".

The "playing field" means a plane on which the medals are deposited. The medals deposited on the playing field are expected to be pushed out frontward on the playing field by the medal pusher 10 mentioned later. The medals, which are pushed out, exceed the side edge and fall from the playing field. The player gains the fallen medals.

The "medal inlet device" is a device which supplies the medals to roll on the playing field. The medal inlet device is formed in a gutter-shape with a width slightly wider than the thickness of the medal. The medal inlet device is preferably made to pivot horizontally as well as vertically within given angles so that the player can adjust, to a certain extent, a direction and a position to supply the medal. Some of the medals supplied onto the playing field by the medal inlet device may roll to pass through the medal-passing gate 21 mentioned later and other medals are deposited on the playing field.

The "medal pusher" is a device which moves reciprocatedly in a longitudinal direction on the playing field. Here, "reciprocatedly in a longitudinal direction" means that the medal pusher comes near to and goes away from the player repeatedly.

On the near side of this medal pusher 10, "a pushing plate" which directly comes into contact with the medals deposited on the playing field is mounted. When the medal pusher 10 comes near to the player, this pushing plate 20 pushes out the medals frontward.

The "medal-passing gate" means an opening formed in said pushing plate 20 with a height higher than a diameter of the medal. When the medal passes through this medal-passing gate 21, a profitable condition is usually afforded to the player. Thus, the player supplies the medals so that the medals may pass through the medal-passing gate 21. However, the "vane plates" described below are provided in order to obstruct the medals from passing through.

This medal-passing gate 21 is provided with a plurality of "vane plates" which obstruct the medals from passing through. Each vane plate 60 is arranged with an interval wide enough for the rolling medal to pass through. Further, an end of each vane plate 60 protrudes frontward from the pushing plate 20 so that the protruding end may pivot.

Namely, in the medal playing machine according to the present invention, the medal pusher 10 moves reciprocatedly on the playing field while the vane plates 60 pivot at the medal-passing gate 21.

Then, while watching the vane plates 60 pivot, the player supplies the medal with the medal inlet device so that the medal may pass through the medal-passing gate 21.

When the supplied medal successfully passes through between the vane plates 60, the above-mentioned profitable condition comes to occur. For example, a prescribed number of medals will be supplied from the medal supplier, which is provided above the playing field, onto the playing field as the medal passes through the medal-passing gate 21. In this case, since the pushing plate 20 pushes out more medals, more medals will fall from the side edge. As a result, the player can gain more medals.

The above-mentioned profitable condition may occur according to a result of a prescribed lot drawing after the medal passes through the medal-passing gate 21. For example, in the above-mentioned example, according to the result of the lot drawing, the medal supplier may supply the medals or may not. Further, even when the medals are supplied, the number of the supplied medals may differ according to the result of the lot drawing.

On the other hand, the medal supplied in bad timing cannot pass through between the vane plate 60 and, impinging on the vane plates 60, falls down to be deposited on the playing field.

Thus, since the player has to supply the medal watching the timing of the longitudinal movement of the pushing plate 20 as well as the pivoting of the vane plates 60, the player is requested to have a skill to a certain extent in order to get more medals.

Further, the difficulty of the game can be adjusted by suitably controlling a cycle of the longitudinal movement of the pushing plate 20 and that of the pivoting of the vane plates 60. For example, it is possible to completely synchronize both cycles or to operate the pushing plate 20 and the vane plates 60 in irrelevant cycles.

Further, various mechanisms can be employed as a mechanism for pivoting the vane plates 60 in the medal playing machine according to the present invention.

For example, as the present invention, the above-mentioned medal pusher 10 may comprise a cam 30 rotated by a motor, a link plate 40 which converts the rotational movement of said cam 30 into the pivotal movement in a transverse direction, and a reciprocating plate 50 which converts the pivotal movement of the link plate 40 into the reciprocating linear movement in a longitudinal direction. The vane plates 60 are pivotally supported by movable shafts 63 nearly at the front edge of the reciprocating plate 50. The vane plates 60 are also pivotally supported by stationary shafts 61 in the vicinity of the medal-passing gate 21. Due to the reciprocating movement of the above-mentioned reciprocating plate 50 in a transverse direction, the distal ends of the vane plates 60 can pivot around the stationary shafts 61 in front of the pushing plate 20.

Namely, the rotational movement of the cam 30 rotated by the motor mounted on the medal pusher 10 is once converted into the pivotal movement of the link plate 40, and this pivotal movement is converted into the reciprocating linear movement of the reciprocating plate 50 in a transverse direction. Further, this reciprocating linear movement is converted into the pivotal movement of the vane plates 60.

As a method for converting the rotational movement of the cam 30 into the pivotal movement of the link plate 40, for example, an eccentric shaft 33, whose axis is not aligned with the rotational axis of the motor, may be mounted on the cam 30. Thus the cam 30 may be connected to an end (hereinafter referred to as a "distal end") of the link plate 40 by means of this eccentric shaft 33. Here, by providing a fulcrum nearly in the middle of the link plate 40, another end of the link plate 40, namely, the end opposite to the distal end (hereinafter referred to as a "proximal end") may pivot. However, the distance between the eccentric shaft 33 of the cam 30 and the fulcrum of the link plate 40 changes according to the rotation of the cam 30. This difference of distance can be cancelled by an elongated hole provided in the distal end 41, at which the link plate 40 is connected with the eccentric shaft 33.

A following constitution may be adopted for converting the pivotal movement of the link plate 40 to the linear movement of the reciprocating plate 50. First, a rail 14 which extends in a transverse direction is mounted on the medal pusher 10 and the reciprocating plate 50 is made to move on the rail 14. Then, the proximal end 44 of the link plate 40 is connected with this reciprocating plate 50. When an elongated hole is formed at the site of the connection at the proximal end 44, the difference of the distance between the fulcrum of the link plate 40 and the site of the connection can be cancelled. Due to this constitution, the pivotal movement of the link plate 40 can be converted into the reciprocating linear movement of the reciprocating plate 50 in a transverse direction.

A following constitution may be adopted for converting the reciprocating linear movement of the reciprocating plate 50 in a transverse direction into the pivotal movement of the vane plates 60. First, the vane plate 60 is formed as a rectangular plate with a given thickness. The plate is made to have two holes penetrated through its edges. On the other hand, vertical "stationary shafts" are fixed to the medal pusher 10 in the vicinity of the medal-passing gate 21. Each stationary shaft 61 is made to pass through one of the penetrated holes. Further, at the front edge of the reciprocating plate 50, vertical "movable shafts" which move relatively to the medal pusher 10. Each movable shaft 63 is made to pass through the other penetrated hole. The penetrated hole through which the movable shaft 63 passes is made to have a play.

Namely, the vane plate 60 is pivotally supported both by the stationary shaft 61 stationarily disposed relative to the medal pusher 10 and by the movable shaft 63 which moves relatively to the medal pusher 10. Then, when the reciprocating plate 50 moves reciprocatedly in a transverse direction, the vane plate 60 pivots around the stationary shaft 61, which serves as a fulcrum, being forced by the movable shaft 63. Here, since the penetrated hole through which the movable shaft 63 passes is made to have a play, the difference of the distance between the movable shaft 63 and the stationary shaft 61 caused by the reciprocating movement of the reciprocating plate 50 can be cancelled.

Further, in the present invention, the stationary shafts 61 of the vane plates 60 may be disposed in front of the movable shafts 63.

Namely, in the case that the stationary shafts 61 of the vane plates 60 are positioned in front of the movable shafts 63, when the reciprocating plate 50 moves leftward, the front ends of the vane plates 60 pivot rightward. Further, when the reciprocating plate 50 moves rightward, the front ends of the vane plates 60 pivots leftward.

Moreover, in the present invention, the vane plates 60 provided with the stationary shafts 61 in front of the movable shafts 63 and the vane plates 60 provided with the stationary shafts 61 behind the movable shafts 63 may be alternately arranged.

Namely, when the positional relationship between the stationary shaft 61 and the movable shaft 63 of one vane plate 60 differs to that of the neighboring vane plate 60, the vane plates 60, 60 can pivot as if they open and close. For example, of two neighboring vane plates 60, 60, the left vane plate 60 is made to have its stationary shaft 61 in front of its movable shaft 63, and the right vane plate 60 is made to have the stationary shaft 61 positioned oppositely. In this case, when the reciprocating plate 50 moves leftward, the front end of the left vane plate 60 pivots rightward and the front end of the right vane plates 60 pivots leftward oppositely. Namely, these vane plates 60, 60 pivot as if they close. On the other hand, when the reciprocating plate 50 moves rightward, the front end of the left vane plate 60 pivots leftward and the front end of the right vane plate 60 pivots right ward oppositely. Namely, these vane plates 60, 60 pivot as if they open.

Further, the present invention preferably includes an indicator 34 mounted on the cam 30 and cam monitor which detects the passage of the indicator 34 by the rotation of the cam 30. The cam monitor is preferably formed to generate an emergency signal when the passage of the indicator 34 is not detected for more than a given time.

The "indicator" is the means for indicating the rotational condition of the cam 30. For example, when the cam 30 has a circular appearance, a protrusion from the circumference of the cam 30 may be formed as the indicator 34.

As the "cam monitor," for example, a beam sensor may be adopted. By making the indicator 34 interrupt the light beams of the above-mentioned beam sensor by every given cycle, the passage of the indicator 34 can be recognized.

The "given time" is suitably a time which is necessary for the cam 30 to perform one rotation. If the medal is entangled to the vane plates 60, the normal rotation of the cam 30 is obstructed and the passage of the indicator 34 cannot be detected for more than the given time. In this case, the cam monitor generates an emergency signal. This emergency signal is transmitted to, e.g., a control unit of the medal playing machine. Receiving such a signal, the control unit, for example, stops the game or displays an error message.

DETAILED DESCRIPTION

Figure 1:
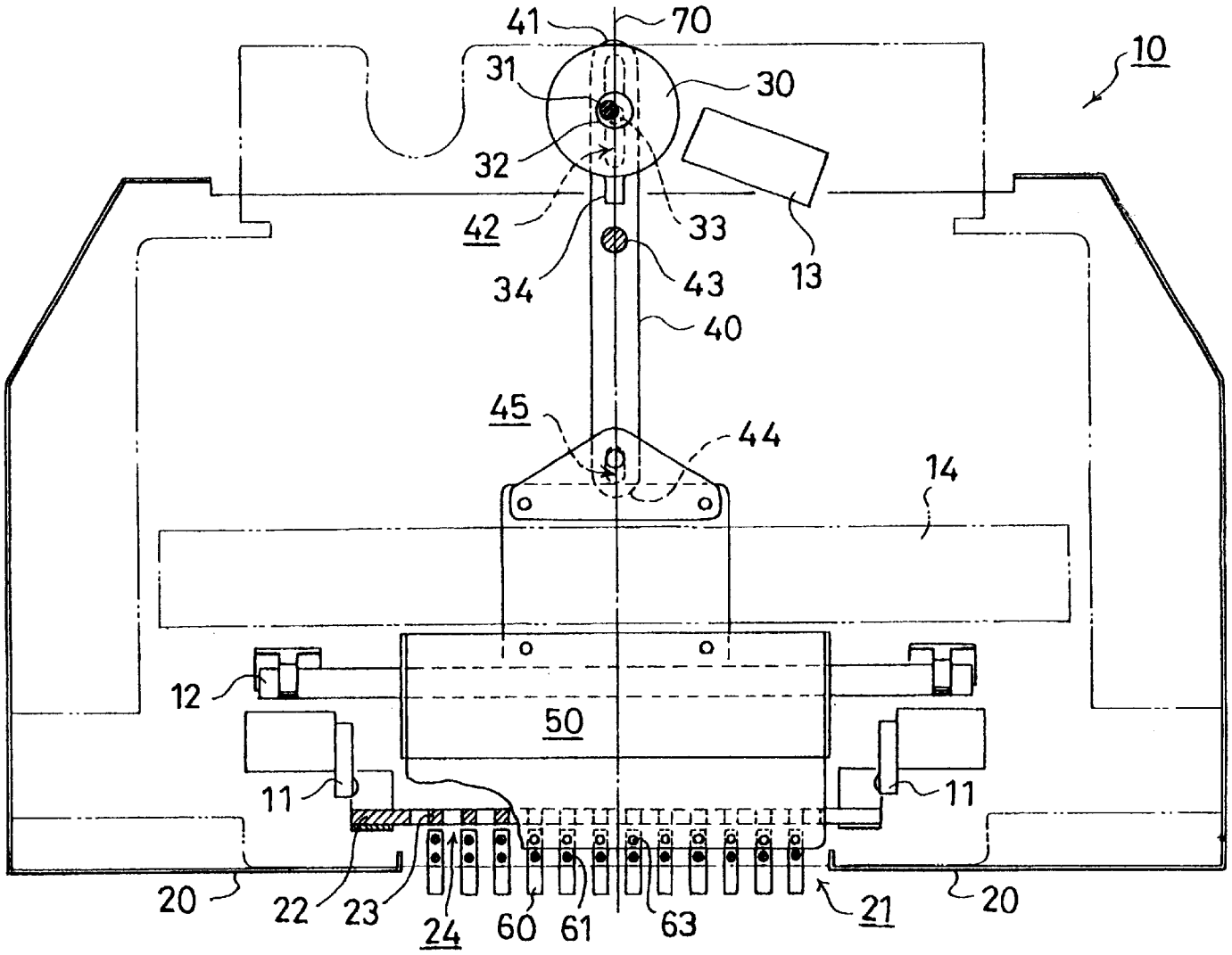
FIG. 1 is a plan view of a medal pusher 10 in a medal playing machine according to the present embodiment. Further.

An embodiment of the present invention is explained hereinafter referring to the drawings.

In the following description, a nearer side to a player is referred to as "frontward" and a far side as "backward".

Summary of the Medal Playing Machine

A medal playing machine according to the present embodiment is provided with a playing field which has a side edge (not illustrated) at its front side. On this playing field, a medal pusher 10 shown in FIG. 1 moves reciprocatedly in a longitudinal direction by means of a driving mechanism (not illustrated). Further, the medal playing machine is provided with a gutter-shaped medal inlet device (not illustrated) for supplying medals one by one by rolling them onto the playing field. This medal inlet device is made to pivot horizontally and vertically so that the player can adjust an angle and a position to supply the medal to a certain extent.

Summary of the Medal Pusher

A front side of the medal pusher 10 is made to be a pushing plate 20 perpendicular to the playing field. The pushing plate 20 is a part which pushes out the supplied medals frontward.

In the middle of the above-mentioned pushing plate 20, a medal-passing gate 21 having a height slightly higher than a diameter of the medal is formed. Behind this medal-passing gate 21 is fixed a comb-shaped obstructing plate 22. Between the teeth 23 of the obstructing plate 22 are slits 24 with a width wide enough for the medals to roll to pass through. Further, in front of each tooth 23, vane plate 60 is disposed so that its front end may protrude frontward through the medal-passing gate 21. Further, this front end of the vane plate 60 is made to pivot transversely. The mechanism for this movement is explained later.

Further, behind the above-mentioned obstructing plate 22, a medal sensor 11 is provided. This medal sensor 11 detects a medal passing through the obstructing plate 22 with a beam sensor. Further behind the medal sensor 11 is a fluorescent lamp 12 which illuminates the inside of the medal pusher 10.

A collection hole (not illustrated) is formed on the playing field. The medal pusher 10 is installed to cover over the collection hole so that the player may not see the collection hole directly. The medals passing through the above-mentioned obstructing plate 22 fall into the collection hole to be collected.

Driving Mechanism of Vane Plates

The driving mechanism of the vane plates 60 is summarized as follows. Namely, the rotational movement of the motor is converted into the reciprocating movement of the reciprocating plate 50 in a transverse direction through the pivotal movement of the link plate 40. And the transverse reciprocating movement of the reciprocating plate 50 makes the vane plates 60 pivot in a transverse direction. The detail of the driving mechanism is explained hereinafter.

At the rear end of the medal pusher 10, a motor (not illustrated) is installed with its motor shaft 31 protruding downward. The motor shaft 31 is connected to a circular cam 30 by way of a fastening part 32. Below the cam 30, an eccentric shaft 33, whose axis is not aligned with that of the motor shaft 31, protrudes downward. An indicator 34 protrudes from the circumference of the cam 30. The indicator 34 is formed to pass through a cam sensor 13 disposed beside the cam 30.

The eccentric shaft 33 of the cam 30 is connected to the rear end (hereinafter referred to as a "distal end") of a link plate 40.

The link plate 40 is pivotally mounted stationarily on the medal pusher 10 at a link fulcrum 43 positioned nearly in the middle of the link plate 40. Then, an elongated hole (hereinafter referred to as a "distal elongated hole") is provided to this distal end 41. The link plate 40 and the eccentric shaft 33 are connected with each other at this distal elongated hole 42. Here, the purpose of this distal elongated hole 42 is to cancel the difference of the distance between the eccentric shaft 33 of the cam 30 and the link fulcrum 43 caused by the rotation of the cam 30. Thus, the rotational movement of the cam 30 is converted into the pivotal movement of the link plate 40 around the link fulcrum 43. Further, an elongated hole (hereinafter referred to as a "proximal elongated hole") is also formed in the front end (hereinafter referred to as a "proximal end") of the link plate 40 and the link plate 40 is connected to the reciprocating plate 50 at this proximal end.

A rail 14 extending transversely is fixed to the medal pusher 10. Then, the reciprocating plate 50 is made to move transversely along this rail 14 relative to the medal pusher 10. The proximal end 44 of the link plate 40 and the rear end of the reciprocating plate 50 are connected with each other. Here, since the proximal elongated hole 45 is formed at the proximal end 44 of the link plate 40, the difference of the distance between the link fulcrum 43 of the link plate 40 and the connecting position can be cancelled. Due to such a constitution, the pivotal movement of the link plate 40 is converted into the reciprocating linear movement of the reciprocating plate 50 in a transverse direction.

The vane plate 60 is vertically penetrated with two holes. The penetrated hole located nearer to the rear end of the vane plate 60 is referred to as a "movable hole" and the penetrated hole nearer to the middle as a "stationary hole." The movable hole is formed to be slightly longer in a longitudinal direction than the stationary hole to have a play. On the other hand, in the vicinity of the medal-passing gate 21 of the medal pusher 10, vertical shafts are fixed to the medal pusher 10. Further, behind these shafts, other vertical shafts which are movable relative to the medal pusher 10 are also mounted on the front edge of the reciprocating plate 50. Here, the former shafts are referred to as stationary shafts 61, while the latter shafts as movable shafts 63. Namely, while the stationary shafts 61 are stationarily mounted relative to the medal pusher 10, the movable shafts 63 are mounted movably in a transverse direction relative to the medal pusher 10. Further, both of the stationary shafts 61 and the movable shafts 63 are positioned in front of the above-mentioned obstructing plate 22. By making the stationary shafts 61 pass through the fixed holes 62 and simultaneously making the movable shafts 63 pass through the movable holes 64, the vane plates 60 are pivotally mounted by means of the stationary shafts 61 and the movable shafts 63. Due to such a constitution, the front ends of the vane plates 60 are protruded frontward from the medal-passing gate 21.

Accordingly, when the reciprocating plate 50 moves reciprocatedly in a transverse direction, the movable shafts 63 also moves reciprocatedly in a transverse direction and the rear ends of the vane plates 60 also moves reciprocatedly in a transverse direction. Accordingly, the front ends of the vane plates 60 pivot transversely around the stationary shafts 61. Here, since the play is provided to each movable holes 64 as mentioned above, the difference of the distance between the movable shaft 63 and the stationary shaft 61 caused by the reciprocating movement of the reciprocating plate 50 can be cancelled.

Explanation of the Manner of Operation

Figure 2:
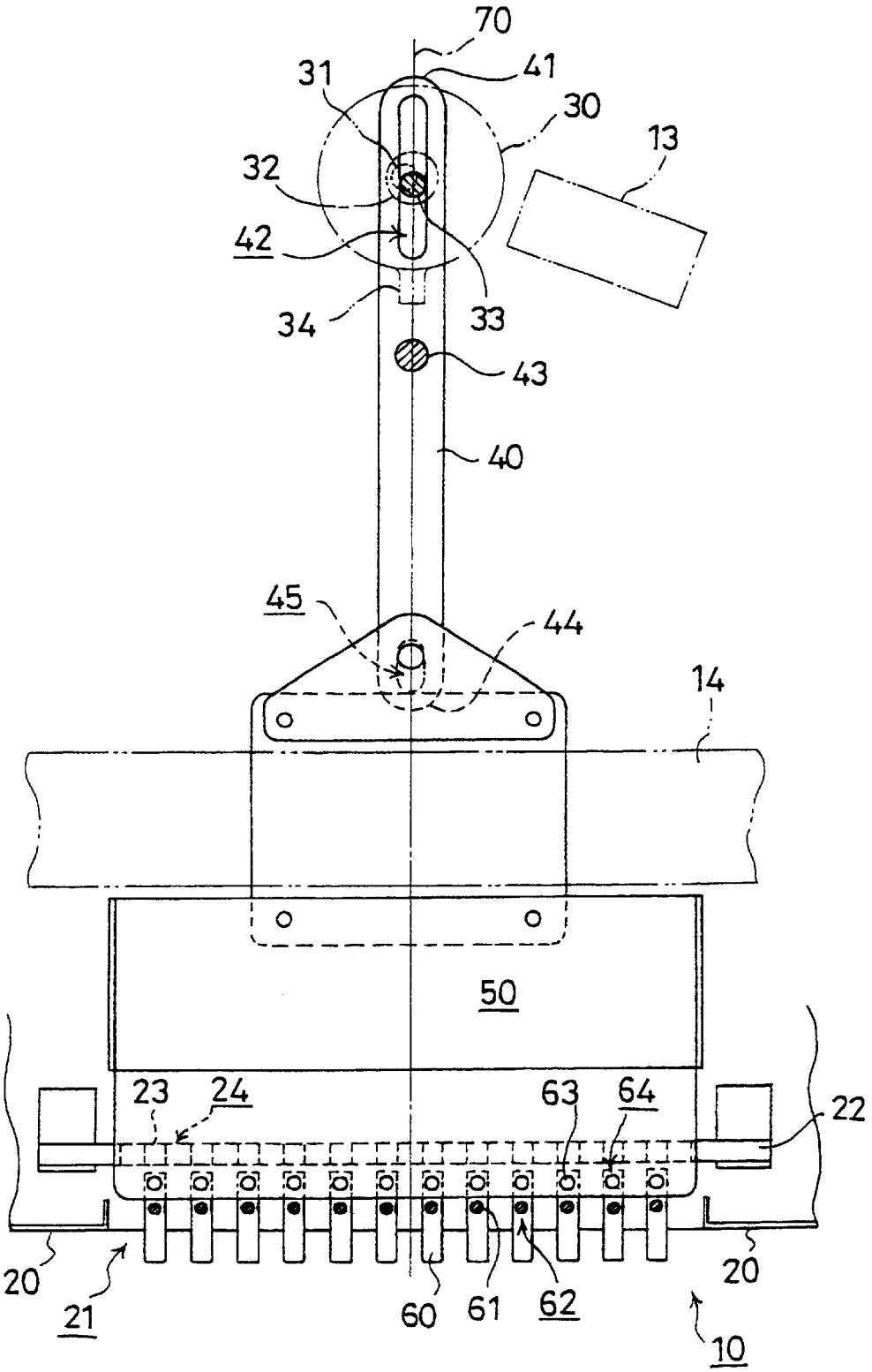
FIGS. 2 to 4 are plan views explaining the operation of vane plates which constitute an essential part of the medal pusher 10.
Figure 3:
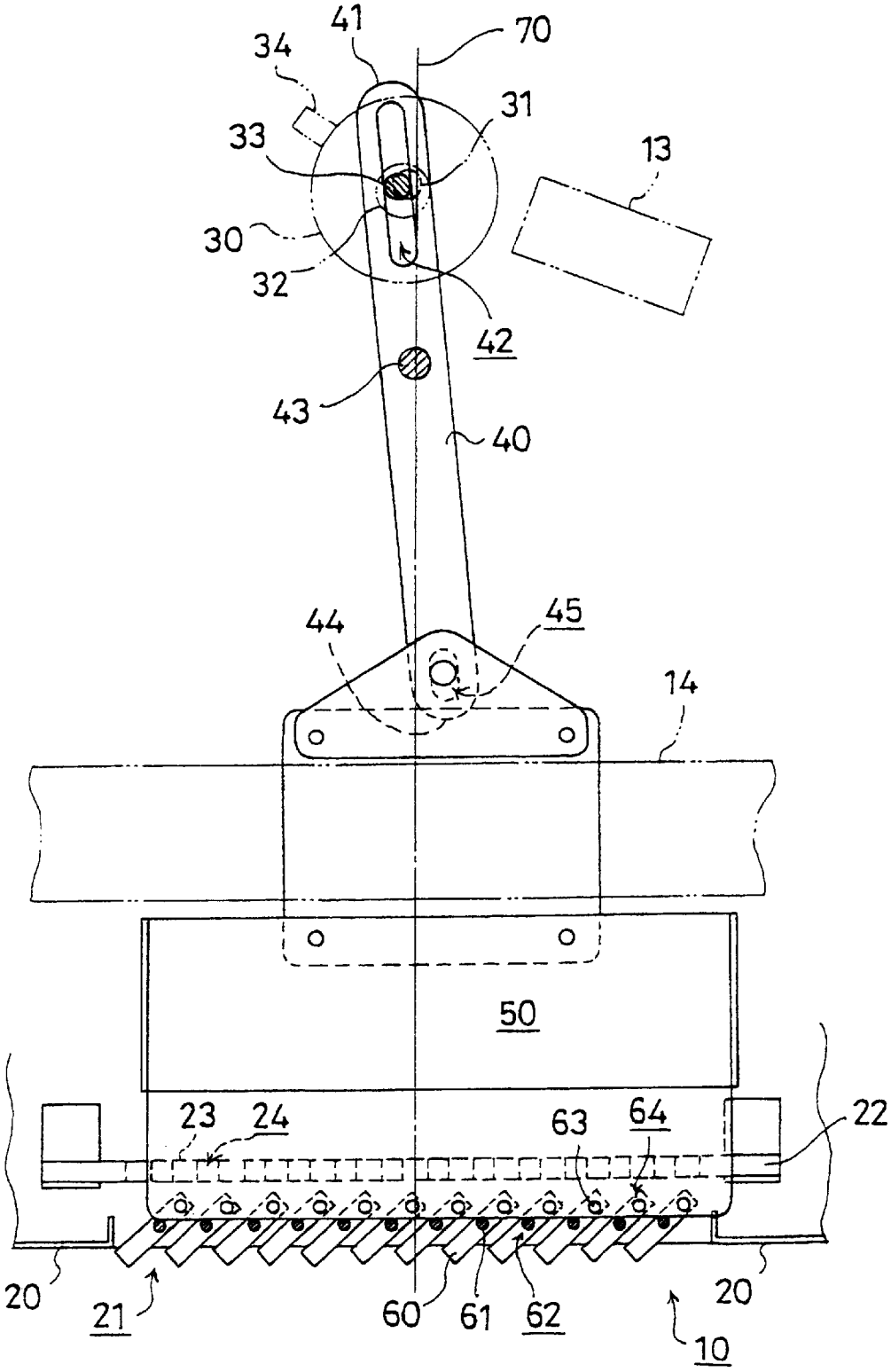
Figure 4:
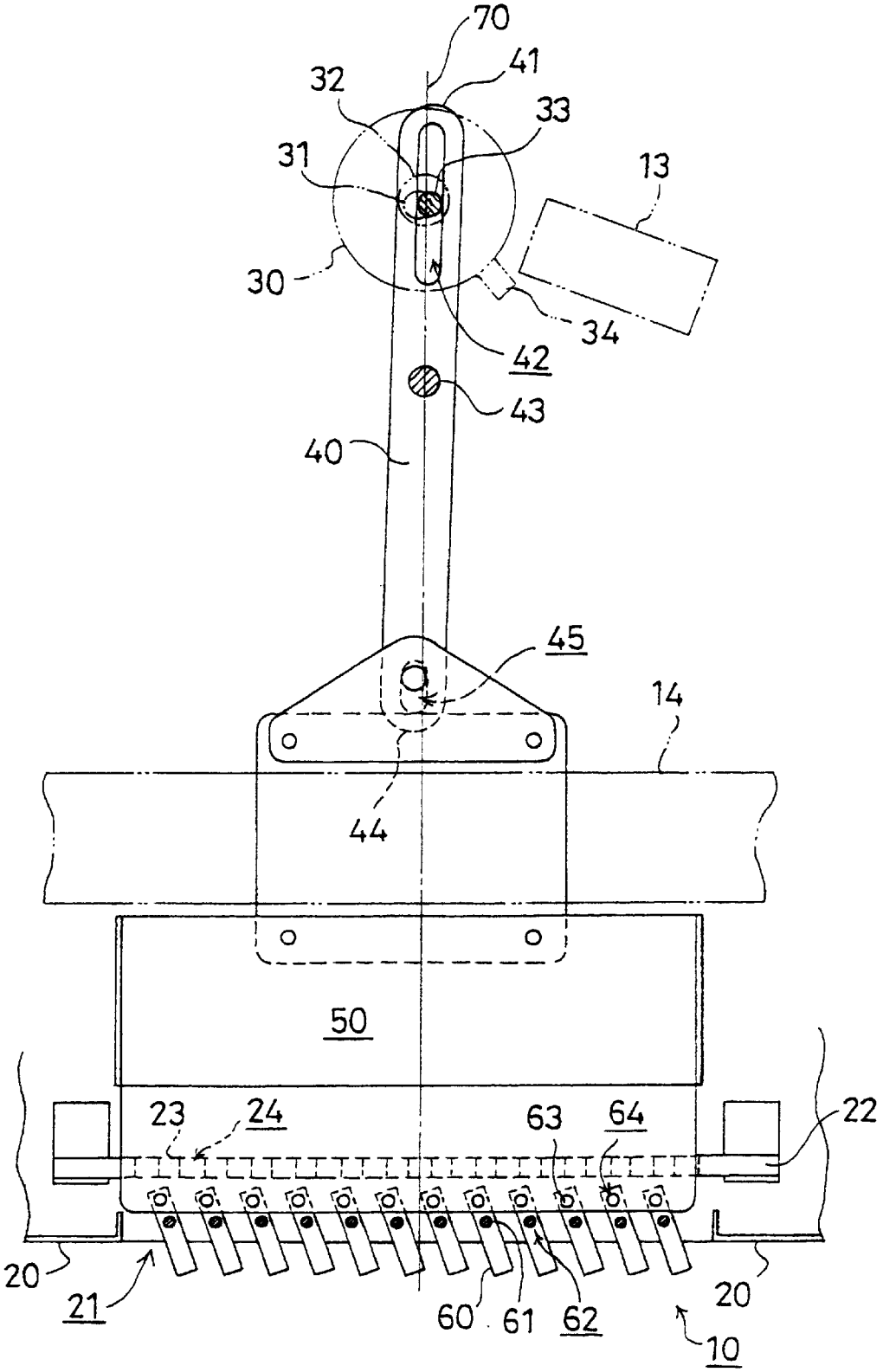

The manner of operation of the vane plates 60 is explained in conjunction with FIGS. 2 to 4. The medal pusher 10 shown in the drawings is assumed to reciprocate repeatedly in a longitudinal direction, though not particularly illustrated. Hereinafter, this direction is referred to as a longitudinal axis 70.

First, the eccentric shaft 33 whose axis is not aligned with the motor shaft 31 rotates around the motor shaft 31 corresponding to the rotation of the motor shaft 31. In the drawings, the motor shaft 31 is assumed to rotate clockwise direction in plan view. Here, when an imaginary straight line which connects the eccentric shaft 33 and the link fulcrum 43 is aligned with the longitudinal axis 70, the direction of the vane plates 60 becomes parallel to the longitudinal axis 70. This state is shown in FIG. 2.

Then, when the eccentric shaft 33 rotates clockwise and locates leftmost, the distal end 41 of the link plate 40 locates leftmost. And the proximal end 44 of the link plate 40 located frontward from the link fulcrum 43 locates rightmost. Corresponding to these movements, the reciprocating plate 50 also locates rightmost and hence, the movable shafts 63 of the vane plates 60 also locate rightmost. Accordingly, the front ends of the vane plates 60 located frontward from the stationary shafts 61 pivot leftward. FIG. 3 shows this state.

Then, when the eccentric shaft 33 rotates clockwise and locates rightmost, the distal end 41 of the link plate 40 locates rightmost. And the proximal end 44 of the link plate 40 located frontward from the link fulcrum 43 locates leftmost. Corresponding to these movements, the reciprocating plate 50 also locates leftmost and hence, the movable shafts 63 of the vane plates 60 also locate leftmost. Accordingly, the front ends of the vane plates 60 located frontward from the stationary shafts 61 pivot rightward. FIG. 4 shows this state. During these movements, the indicator 34 passes though the cam sensor 13.

Then, the eccentric shaft 33 is further rotated, and the vane plates 60 start pivoting rightward again and return to the state shown in FIG. 2.

As described above, the medal pusher 10 reciprocates repeatedly in a longitudinal direction while the vane plates 60 pivot in a transverse direction. During these movements, the player carefully watches the movement of the vane plates 60 and supplies medals from the medal inlet device in a timing that the player may think appropriate.

Here, for example, assuming that the medal is supplied from the right side, when the front ends of the vane plates 60 direct leftward as shown in FIG. 3, the medal impinges on the vane plates 60. Thus the medal cannot pass through the slits 24 of the obstructing plate 22. Accordingly, the medal which impinges on the vane plates 60 turns down and is deposited on the playing field.

On the other hand, when the front ends of the vane plates 60 direct right ward as shown in FIG. 4, the medal can roll through between the vane plates 60 and hence can pass through the slits 24 of the obstructing plate 22. Here, when the medal sensor 11 detects the passage of the medal, a prescribed profitable condition is afforded to the player in accordance with the result of a prescribed lot drawing. Further, the medal which passes through the obstructing plate 22 turns down behind the obstructing plate 22. When the medal pusher 10 moves backward, the medal is scraped off backward by the obstructing plate 22 and is made to fall in the collection hole not shown in the drawing.

Here, in case the medal is entangled between the vane plates 60, the pivotal movement of the vane plates 60 is obstructed and an abnormal load is applied to the rotation of the cam 30. Thus the cycle of rotation of the cam 30 becomes irregular. In this case, since the timing that the indicator 34 mounted on the circumference of the cam 30 passes through the cam sensor 13 (i.e. the period from the state shown in FIG. 3 to that shown in FIG. 4) is delayed, a passage signal is not generated for a time longer than the normal cycle of the rotation. Then, a control unit of the medal playing machine recognizes that there occurs an abnormal state and the control unit stops the game, and then simultaneously displays an error message.

Another Embodiment

Figure 5:
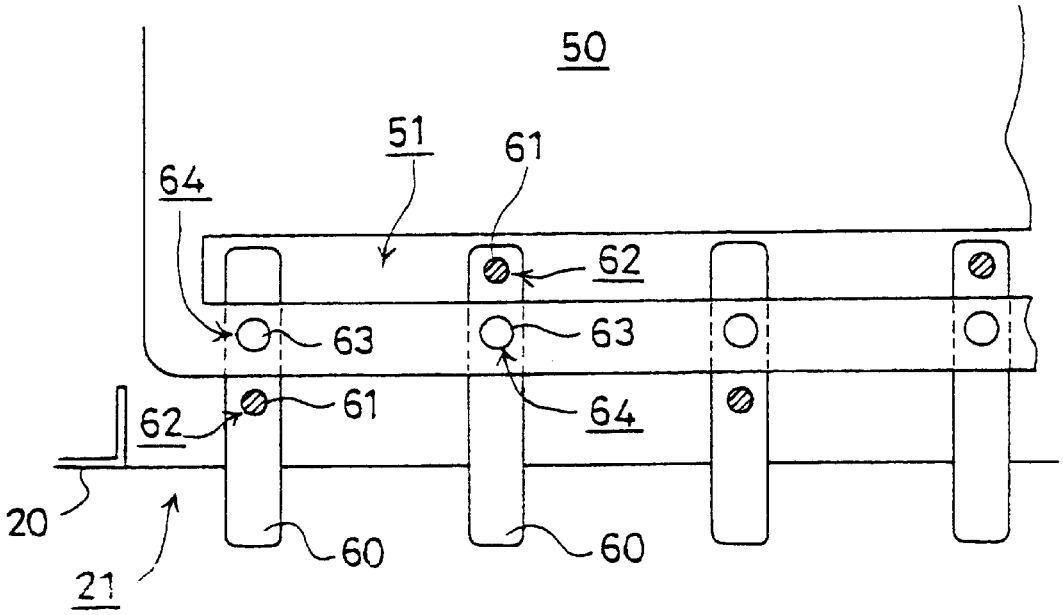
FIG. 5 is a plan view showing the arrangement of the vane plates in another embodiment of the present invention.

In another embodiment, for example, shown in FIG. 5, the vane plates 60, 60 can move as if they open and close when they are arranged so that the longitudinal relationship between the movable shaft 63 and the stationary shaft 61 may differ alternately in neighboring vane plates 60. Namely, when a pivotal opening 51 which allows the vane plate 60 to pivot is provided behind the position where the movable shaft 63 is provided in the reciprocating plate 50, the rear end of the vane plate 60 can be pivotally supported to the medal pusher 10 by the stationary shaft 61 through the pivotal opening 51.

Figure 6:
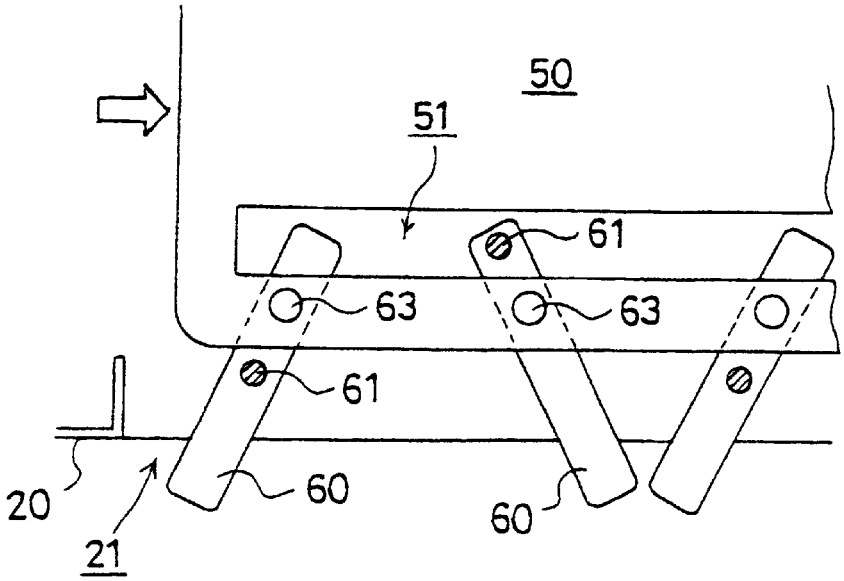
FIGS. 6 and 7 are plan views schematically showing the operation of the vane plates in another embodiment of the present invention.

Due to such a constitution, when the reciprocating plate 50 moves rightward, the vane plates 60 in which the stationary shafts 61 are provided in front of the movable shafts 63 pivot leftward and the vane plates 60, on the other hand, in which the stationary shafts 61 are provided behind the movable shafts 63 pivot rightward. Thus both vane plates 60, 60, as shown in FIG. 6, pivot as if they o pen.

Figure 7:
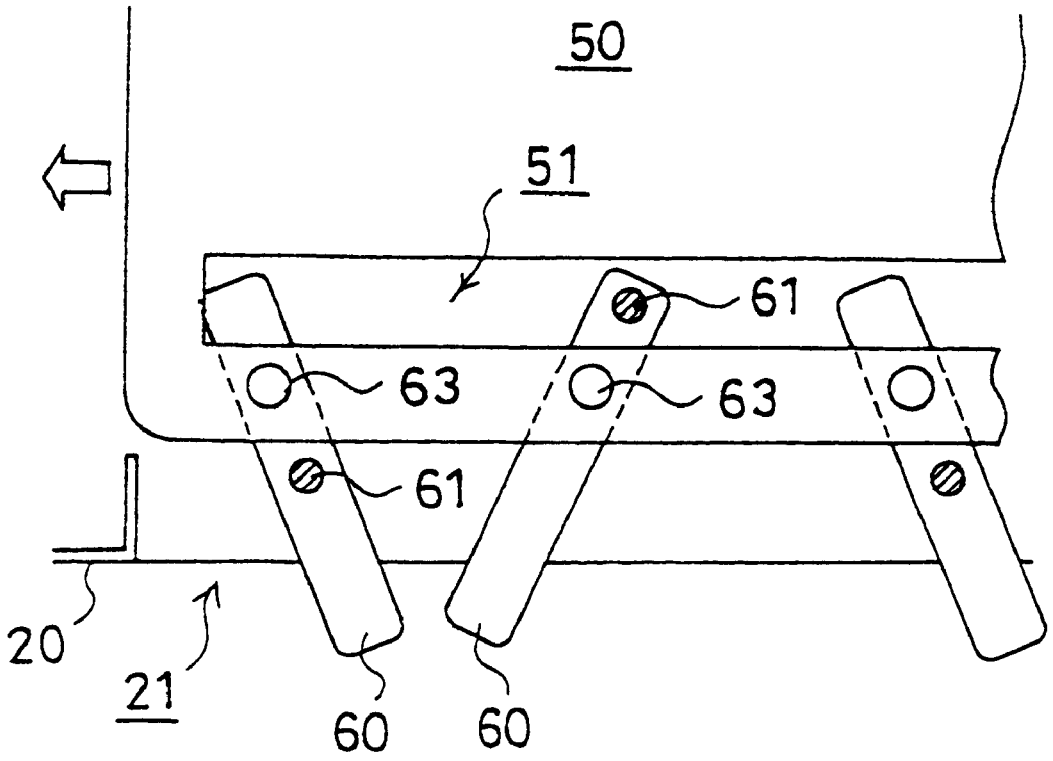

Moreover, when the reciprocating plate 50 moves leftward, the vane plates 60 in which the stationary shafts 61 are provided in front of the movable shafts 63 pivot rightward and the vane plates 60, on the other hand, in which the stationary shafts 61 are provided behind the movable shafts 63 pivot leftward. Thus both vane plates 60, 60, as shown in FIG. 7, pivot as if they close.

According to the above-mentioned constitution, the present invention can achieve following advantageous effects.

Namely, by providing the vane plates which can obstruct the medals from passing through the medal-passing gate in front of the medal-passing gate in place of the obstructing plate due to the pivoting in a transverse direction, the present invention can provide the medal playing machine which can make the movement pattern complicated and facilitates the adjustment of the difficulty of the game.

Namely, the present invention makes it possible to provide a medal playing machine which has a complicated movement pattern of the vane plates, instead of the obstructing plate, and in which the difficulty of the game can easily be adjusted, by providing the vane plates which pivot transversely in front of the medal-passing gate and thus obstruct the medals from passing through the medal-passing gate.

Further, the present invention wherein the indicator is provided makes it possible, in addition to the above-mentioned effects, to detect the abnormal operation caused by the entanglement of the medal.

INDUSTRIAL APPLICABILITY

As has been explained heretofore, the present invention can present interesting games performed in the medal playing machine wherein the medals or the like can show a complicated movement pattern and the difficulty of the game can be adjusted.

What is claimed is:

1. A medal playing machine comprising:

a playing field which has a side edge at its front side, a gutter-shaped medal inlet device for supplying medals by rolling them onto said playing field, and a medal pusher which moves on said playing field reciprocatedly in a longitudinal direction;

wherein:

said medal pusher has a pushing plate which pushes out the medals supplied and deposited on said playing field towards said side edge so as to make said medals fall;

said pushing plate is provided with a medal-passing gate through which the medals may rolls to pass on said playing field; and a plurality of vane plates which obstructs the medals from passing through by pivoting transversely are provided at said medal-passing gate so that front ends of said vane plates protrude frontward from said pushing plate.

2. A medal playing machine according to claim 1, wherein:

said medal pusher also comprises a cam which is rotated by a motor, a link plate which converts the rotational movement of said cam into the pivotal movement in a transverse direction, and a reciprocating plate which converts the pivotal movement of said link plate into the reciprocating linear movement in a transverse direction;

said vane plates are pivotally supported in the vicinity of a front edge of said reciprocating plate by movable shafts which are rotatable and are also pivotally supported in the vicinity of said medal-passing gate by stationary shafts, and said front ends of said vane plates pivot around said stationary shafts in front of said pushing plates according to the reciprocating movement of said reciprocating plate in a transverse direction.

3. A medal playing machine according to claim 2, wherein said stationary shafts of the vane plates are disposed in front of the movable shafts.

4. A medal playing machine according to claim 2, wherein the vane plates having the stationary shafts in front of the movable shafts and the vane plates having the stationary shafts behind the movable shafts are alternately arranged.

5. A medal playing machine according to claim 1, wherein:

an indicator which is mounted on the cam and cam monitor which detects the passage of the indicator by means of the rotation of the cam are also provided, and said cam monitor is made to generate an emergency signal when the passage of the indicator is not detected for more than a given time.

6. A medal playing machine according to claim 2, wherein:

an indicator which is mounted on the cam and cam monitor which detects the passage of the indicator by means of the rotation of the cam are also provided, and said cam monitor is made to generate an emergency signal when the passage of the indicator is not detected for more than a given time.

7. A medal playing machine according to claim 3, wherein:

an indicator which is mounted on the cam and cam monitor which detects the passage of the indicator by means of the rotation of the cam are also provided, and said cam monitor is made to generate an emergency signal when the passage of the indicator is not detected for more than a given time.

8. A medal playing machine according to claim 4, wherein:

an indicator which is mounted on the cam and cam monitor which detects the passage of the indicator by means of the rotation of the cam are also provided, and said cam monitor is made to generate an emergency signal when the passage of the indicator is not detected for more than a given time.

* * * * *

UNITED STATES PATENT AND TRADEMARK OFFICE

CERTIFICATE OF CORRECTION

PATENT NO. : 6,431,542 B1
DATED : August 13, 2002
INVENTOR(S) : Kazuhisa Tabuchi It is certified that error appears in the above-identified patent and that said Letters Patent is hereby corrected as shown below:

Title page,
Item [22], PCT Filed: Please change the date from "February 2, 2000" to -- February 4, 2000 --.

Signed and Sealed this

Tenth Day of December, 2002

JAMES E. ROGAN
*Director of the United States Patent and Trademark Office*